US008132417B2

(12) United States Patent
Steiger et al.

(10) Patent No.: US 8,132,417 B2
(45) Date of Patent: Mar. 13, 2012

(54) COOLING OF A GAS TURBINE ENGINE DOWNSTREAM OF COMBUSTION CHAMBER

(75) Inventors: Ulrich Steiger, Dättwil (CH); Willy Heinz Hofmann, Baden-Rütihof (DE)

(73) Assignee: ALSTOM Technology Ltd., Baden (CH)

( * ) Notice: Subject to any disclaimer, the term of this patent is extended or adjusted under 35 U.S.C. 154(b) by 68 days.

(21) Appl. No.: 12/699,970

(22) Filed: Feb. 4, 2010

(65) Prior Publication Data

US 2010/0146988 A1 Jun. 17, 2010

Related U.S. Application Data

(63) Continuation of application No. PCT/EP2008/060320, filed on Aug. 6, 2008.

(30) Foreign Application Priority Data

Aug. 6, 2007 (DE) ..... 10 2007 037 070

(51) Int. Cl.
*F02C 7/12* (2006.01)

(52) U.S. Cl. ..... 60/806; 60/804; 60/805; 60/800; 60/796; 415/115; 415/97 R

(58) Field of Classification Search ..... 60/804, 60/752, 754–760, 806, 800, 796, 805; 415/115, 415/97 R See application file for complete search history.

(56) References Cited

U.S. PATENT DOCUMENTS

| | | | | |
|---|---|---|---|---|
| 4,420,288 | A * | 12/1983 | Bischoff | 416/244 A |
| 5,398,496 | A * | 3/1995 | Taylor et al. | 60/796 |
| 5,466,123 | A * | 11/1995 | Rose | 415/182.1 |
| 2005/0100439 | A1 * | 5/2005 | Greim et al. | 415/173.5 |

FOREIGN PATENT DOCUMENTS

| | | |
|---|---|---|
| EP | 0902164 | 3/1999 |
| EP | 1674659 | 6/2006 |
| EP | 1731711 | 12/2006 |
| EP | 1741877 | 1/2007 |
| GB | 2281356 | 3/1995 |
| WO | WO2009/019282 | 2/2009 |

* cited by examiner

*Primary Examiner* — Ehud Gartenberg
*Assistant Examiner* — Nicholas Karnezos
(74) *Attorney, Agent, or Firm* — Cermak Nakajima LLP; Adam J. Cermak

(57) ABSTRACT

A gas turbine system includes a combustion chamber (2), a turbine (3), a radially inward and/or radially outward axial gap (4; 16, 17) between the combustion chamber (2) and the turbine (3), at which gap inner and/or outer combustion chamber walls (7, 8) and inner and/or outer turbine walls (11, 12) end, and a cooling gas supply (5), which via the gap (4; 16, 17) introduces a cooling gas into the turbine gas path (13) and/or into the combustion chamber gas path (9). An end section (21, 22, 23, 24) of the respective turbine wall (11, 12) and/or of the respective chamber wall (7, 8) adjoining the gap (4; 16, 17) is radially inwardly and/or radially outwardly, alternatingly formed.

9 Claims, 1 Drawing Sheet

COOLING OF A GAS TURBINE ENGINE DOWNSTREAM OF COMBUSTION CHAMBER

This application is a Continuation of, and claims priority under 35 U.S.C. §120 to, International application no. PCT/EP2008/060320, filed 6 Aug. 2008, and claims priority therethrough under 35 U.S.C. §§119, 365 to German application no. 10 2007 037 070.0, filed 6 Aug. 2007, the entireties of which are incorporated by reference herein.

BACKGROUND

1. Field of Endeavor

The present invention relates to a gas turbine system, in particular for a utility power plant.

2. Brief Description of the Related Art

Such a gas turbine system typically includes a combustion chamber, which, at least in an annular outlet region having a chamber inner wall and a chamber outer wall, radially delimits a combustion chamber gas path. Such a gas turbine system also typically includes a turbine, which, at least in a stationary annular inlet region having a turbine inner wall and a turbine outer wall, radially delimits a turbine gas path. To avoid excessive stress on components during transient operating states of the gas turbine system, the gas turbine system may also be provided with a radially inward and/or radially outward gap extending axially between the combustion chamber and the turbine, at which gap the inner and/or outer chamber wall and the inner and/or outer turbine wall end. To prevent entry of hot working gases into this gap, a cooling gas supply may also advantageously be provided, which via the gap introduces a cooling gas into the turbine gas path and/or into the combustion chamber gas path.

However, supplying cooling gas to the working gas of the gas turbine system directly reduces the power and efficiency thereof. It is therefore desirable to use as little cooling gas as possible.

Gas turbines are known from U.S. Pat. No. 6,283,713 B1 and GB 2,281,356 A, in which at least, for one row of guide vanes, the radially inwardly situated platforms of the individual guide vanes are contoured in such a way that an undulating surface profile results in the circumferential direction. In this manner the static pressure in the working gas may be influenced in such a way that, in the ideal case, in the circumferential direction an essentially constant static pressure results directly downstream from the row of guide vanes.

A gas turbine is known from U.S. Patent Application Pub. No. 2006/0034689 A1, in which a row of guide vanes has a plurality of airfoil members at its inlet side which protrude radially into the gas path. By use of these airfoil members, leakage flow which flows around the blade tips of upstream rotor blades may be reduced or deflected in the axial direction, thus increasing the efficiency of the gas turbine.

SUMMARY

One of numerous aspect of the present invention includes, for a gas turbine system of the aforementioned type, an improved embodiment which is characterized in particular by increased efficiency.

Another of these aspects includes the general concept of achieving a pressure distribution in the gap which influences the cooling gas flow by targeted positioning of positive and negative stages along the gap which alternate in the circumferential direction. This pressure distribution may be set in a targeted manner so that regions with a greater cooling demand are impinged on with a higher cooling gas flow than regions having a lesser cooling demand. The overall quantity of required cooling gas may thus be reduced, which ultimately increases the efficiency of the gas turbine system.

To allow implementation of the positive and negative stages which alternate in the circumferential direction, the combustion chamber wall or the turbine wall is correspondingly contoured in the end section adjoining the gap.

The contours, which vary in the circumferential direction, of the particular chamber wall and of the particular turbine wall in the region of the radially inner gap and/or in the region of the radially outer gap, may be selected and designed on the basis of various criteria. For example, a distribution, present in the circumferential direction, of alternating pressure sides and suction sides of guide vanes of a row of guide vanes situated in the stationary inlet region, may be used for designing the configuration of positive and negative stages at the gap which alternate in the circumferential direction. This row of guide vanes situated in the inlet region is typically the so-called "first row of guide vanes." Upstream all the way to the gap, the pressure sides and suction sides of the guide vanes also cause variations in pressure in the circumferential direction, which may have an effect on the cooling gas flow in the gap. These disadvantageous influences may be reduced by correspondingly taking the pressure sides and suction sides into account in the dimensioning and positioning of the stages along the gap.

Additionally or alternatively, it is possible to take into account a dependency of bow waves of guide vanes of a row of guide vanes situated in the stationary inlet region, the bow waves being generated during operation of the gas turbine system, consecutively following one another at intervals in the circumferential direction, and propagating upstream. Such bow waves may also propagate all the way to the gap, and may influence the pressure distribution at that location. The negative influences of the bow waves on the cooling gas flow may be reduced by taking the distribution of the bow waves into account.

Additionally or alternatively, in the design of the stages at the gap, it is also possible to take into account a pressure distribution which varies in the circumferential direction and which results at or in the outlet region of the combustion chamber during operation of the gas turbine system. It has been shown that, in the circumferential direction, different flow velocities or varying pressures may occur in the outlet region of the combustion chamber. The pressure distribution or velocity distribution which results during stationary operation of the gas turbine may be stationary, and for a multiburner combustion chamber, for example, may possibly be attributed to the burners distributed in the circumferential direction. The pressures in the outlet region of the combustion chamber which vary in the circumferential direction likewise influence the cooling gas flow through the gap. The disadvantageous influence on the cooling gas flow may be reduced by correspondingly taking into account the pressure distribution in the outlet region of the combustion chamber.

Further important features and advantages of the gas turbine system according to principles of the present invention result from the drawings and the associated description of the figures with reference to the drawings.

BRIEF DESCRIPTION OF THE DRAWINGS

Preferred exemplary embodiments of the invention are illustrated in the drawings and explained in greater detail in the following description.

The single FIGURE.

DETAILED DESCRIPTION OF EXEMPLARY EMBODIMENTS

Figure 1:
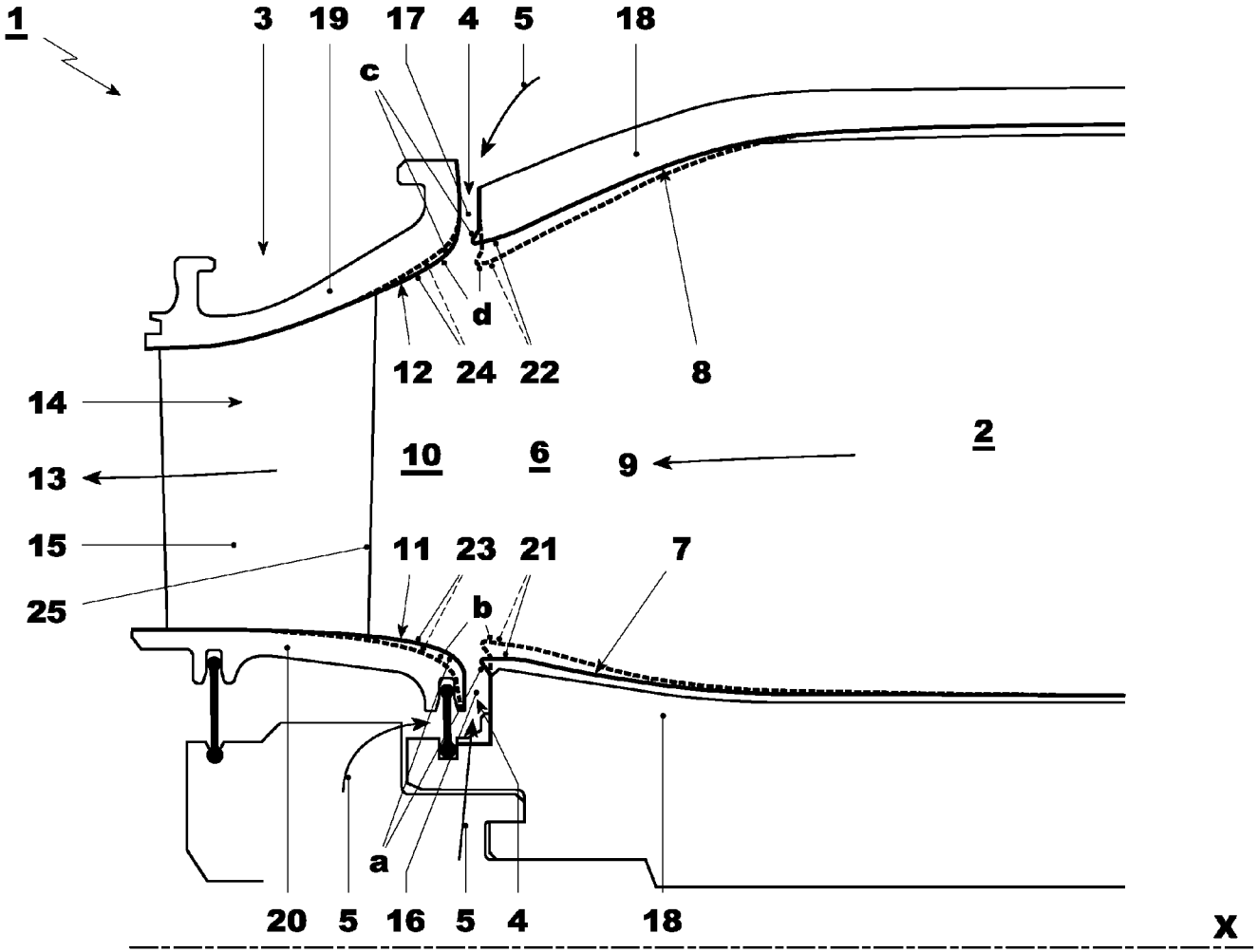
FIG. 1, shows a greatly simplified axial section of a gas turbine system in the region of a gap between a combustion chamber and a turbine.

According to FIG. 1, a gas turbine system 1, which is preferably used in a utility power plant, i.e., in stationary operation, includes a combustion chamber 2 and a turbine 3, between which an axial gap 4 is provided. A cooling gas supply 5 indicated by arrows is also provided. A longitudinal center axis or rotational axis X is illustrated in FIG. 1 as a reference for the radial and axial orientation.

The combustion chamber 2, at least in an annular outlet region 6, has a chamber inner wall 7 and a chamber outer wall 8 which together radially delimit a combustion chamber gas path 9 indicated by an arrow. The turbine 3, at least in a stationary, i.e., stator-side, annular inlet region 10, has a turbine inner wall 11 and a turbine outer wall 12 which together radially delimit a turbine gas path 13 indicated by an arrow. In addition, in the stationary inlet region 10, the turbine 3 may typically have a row of guide vanes 14 having multiple guide vanes 15 adjoining in the circumferential direction. Since this row of guide vanes 14 is the first vane row over which the hot gases from the combustion chamber 2 flow, this row is usually also referred to as the first row of guide vanes 14.

In the example shown, the gap 4 is composed of a radially inward gap 16 and a radially outward gap 17. The radially inward gap 16 is also referred to below as an interior gap 16 or inner gap 16. Correspondingly, the radially outward gap 17 is also referred to below as an exterior gap 17 or outer gap 17. The chamber inner wall 7 and the turbine inner wall 11 both end axially at the inner gap 16. The chamber outer wall 8 and the turbine outer wall 12 both end axially at the outer gap 17.

The cooling gas supply 5 is designed in such a way that it introduces a cooling gas into the turbine gas path 13 or into the combustion chamber gas path 9 via the gap 4, i.e., via the respective partial gap 16 or 17. Cooling gas is introduced into the gap 4 to prevent hot gases from the combustion chamber gas path 9 or from the turbine gas path 13 from entering through the gap 4 and into the regions behind the respective chamber walls 7, 8 or turbine walls 11, 12.

Chamber walls 7, 8 may be formed by thermal shield elements or so-called liners 18, for example. Turbine walls 11, 12 may be formed by platforms 19 and 20 which are radially outwardly and inwardly provided at the respective blade root.

To reduce the cooling gas demand, according to principles of the present invention, positive and negative stages are provided in the axial direction at the gap 4 which alternate radially inwardly and/or radially outwardly, i.e., at the inner gap 16 and/or at the outer gap 17, in the circumferential direction. This is achieved by corresponding shaping of an end section of the respective turbine wall 11, 12 or the respective chamber wall 7, 8 adjoining the particular gap 4, i.e., 16 or 17. An end section of chamber inner wall 7 is denoted by reference numeral 21, an end section of chamber outer wall 8 is denoted by reference numeral 22, an end section of turbine inner wall 11 is denoted by reference numeral 23, and an end section of turbine outer wall 12 is denoted by reference numeral 24. Regions of end sections 21 through 24 lying in the sectional plane are represented by solid lines, whereas regions of end sections 21 through 24 offset thereto are represented by dashed lines. In addition, the referenced stages are denoted by lowercase letters a through d. Reference character a denotes a positive stage provided at the inner gap 16, whereas reference character b denotes a negative stage provided at the inner gap 16. A positive stage at the outer gap 17 is denoted by reference character c, whereas a negative stage at the outer gap 17 is denoted by reference character d. A positive stage a, c is present when the respective wall 11, 12 situated downstream radially projects into the respective gas path 9, 13 with respect to the respective wall 7, 8 situated upstream. In contrast, a negative stage b, d is present when the respective wall 7, 8 situated upstream radially projects into the respective gas path 9, 13 with respect to the wall 11, 12 situated downstream.

In principle, it may be sufficient for the sequence of positive and negative stages a, b and c, d which alternate in the circumferential direction to be implemented only at the inner gap 16 or only at the outer gap 17. However, the variant is shown in which the sequence of positive and negative stages a through d which alternate in the circumferential direction is implemented both radially inwardly and radially outwardly at the gap 4.

At the radially inward gap 16 the positive stage a, for example, may be implemented by the fact that the combustion chamber inner wall 7 in the end section 21 adjoining the gap 4, i.e., the inner gap 16, in the region of positive stage a extends in a radially inwardly offset manner relative to the regions adjoining in the circumferential direction on both sides of positive stage a. The inner positive stage a may thus be implemented, for example, solely by contouring the chamber inner wall 7 in the end section 21 thereof.

Additionally or alternatively, the inner positive stage a may be implemented by the fact that the turbine inner wall 11 in the associated end section 23 in the region of positive stage a extends in a radially outwardly offset manner relative to the regions adjoining in the circumferential direction on both sides of positive stage a. In this manner the positive stage a may basically be implemented solely by correspondingly contouring the turbine inner wall 11 in the end section 23.

However, an embodiment is preferred in which a varying contour at the combustion chamber inner wall 7 in the region of the end section 21, as well as a varying contour of the turbine inner wall 11 in the region of the end section 23, cooperate in order to provide the desired positive stage a at the inner gap 16.

Corresponding configuration possibilities apply for the negative stage b provided at the inner gap 16. This negative stage b may be implemented by the fact that the burner inner wall 7 in the end section adjoining the inner gap 16 in the region of negative stage b extends in a radially outwardly offset manner relative to the regions adjoining in the circumferential direction on both sides of negative stage b. Negative stage b may also be implemented by the fact that the turbine inner wall 11 in the end section 23 adjoining the inner gap 16 in the region of negative stage b extends in a radially inwardly offset manner relative to the regions adjoining in the circumferential direction on both sides of negative stage b. Negative stage b may also be implemented by a combination of the above-referenced measures.

The same applies for the outer gap 17. To implement positive stage c at that location, the combustion chamber outer wall 8 in the end section 22 adjoining the outer gap 17 in the region of positive stage c extends in a radially outwardly offset manner relative to the regions adjoining in the circumferential direction on both sides of positive stage c. Likewise, positive stage c may be implemented at the outer gap 17 by the fact that the turbine outer wall 12 in the end section 24 adjoining the outer gap 17 in the region of positive stage c extends in a radially inwardly offset manner relative to the regions adjoining in the circumferential direction on both sides of positive stage c. However, a combination of the two above-referenced measures is preferred.

Negative stage d may be analogously implemented at the outer gap 17, for example, by the fact that the combustion chamber outer wall 8 in the end section 22 adjoining the outer gap 17 in the region of negative stage d extends in a radially inwardly offset manner relative to the regions adjoining in the circumferential direction on both sides of negative stage d. Likewise, negative stage d may be implemented at the outer gap 17 by the fact that the turbine outer wall 12 in the end section 24 adjoining the outer gap 17 in the region of negative stage d extends in a radially outwardly offset manner relative to the regions adjoining in the circumferential direction on both sides of negative stage d. It is clear that here as well, a combination of the two above-referenced measures is preferably implemented in order to form each negative stage d at the outer gap 17.

In FIG. 1 the deviations in the contour of the respective walls 7, 8, 11, 12 are illustrated in an exaggerated manner to provide a clearer understanding for the present description.

Thus, convex and concave regions which, however, continuously merge together may alternate in the circumferential direction at the respective wall 7, 8, 11, 12 in the region of respective end section 21, 22, 23, 24 with regard to the respective gas path 9, 13.

For the design, in particular for the dimensioning and positioning, of the positive and negative stages a, b, c, d, there are various possibilities, each of which may be used alternatively or in a completely or partially cumulative manner. Several criteria are described in greater detail below by way of example, which for the gas turbine system 1 according to principles of the present invention may be implemented separately or collectively or in any given combination.

For example, the configuration of positive and negative stages a, b, c, d which alternate in the circumferential direction may be designed as a function of a cooling demand which results at the particular gap 4 or at the inner gap 16 and/or the outer gap 17 during operation of the gas turbine system 1, and which may vary in particular in the circumferential direction. It is clear that this variation of cooling demand over time in gap 16, 17 is essentially stationary for a stationary operating state of the gas turbine system 1. To increase the flow of cooling gas in a circumferential segment having a higher cooling demand, a negative stage b, d may be provided in this region. As a result of the pressure conditions which result in the gap 4 of such a negative stage b, d, a pressure decrease, and thus an acceleration or a higher flow velocity, for the cooling gas may be achieved in a targeted manner. In contrast, for circumferential segments for which a reduced flow of cooling gas is sufficient, a positive stage a, c may be implemented which results in a pressure increase, and thus a deceleration or reduced flow velocity for the cooling gas.

During operation of the gas turbine system 1, other dynamic effects occur in the region of the gap 4 which may nonuniformly influence the variation in pressure over time in the circumferential direction of the gap 4. These boundary conditions may correspondingly be taken into account in the design of the stage distribution along the gap 4.

For example, for the configuration of positive and negative stages a, b, c, d which alternate in the circumferential direction it is possible to take into account a distribution of pressure sides and suction sides, present in the circumferential direction, of the guide vanes 15 of the first row of guide vanes 14. These pressure sides and suction sides alternate in the circumferential direction, and result from the profiling of the guide vanes 15. Pressure sides and suction sides which alternate in the circumferential direction influence the pressure in the respective gas path 9, 13, and also in the counterflow direction, at least up to the gap 4. The influence of the distribution of pressure sides and suction sides may be correspondingly reduced or used for adjusting the desired cooling gas distribution by appropriately taking this distribution into account in the design of the stages at the gap 4.

During operation of the gas turbine system 1, so-called bow waves may also form at the leading edges of the guide vanes 15 of the first row of guide vanes 14, which propagate in the direction opposite the flow direction and which are able to reach at least the gap 4. Such bow waves likewise result in stationary influencing of the pressure distribution in the gap in the circumferential direction 4. This effect may be reduced or used for the desired cooling by appropriately taking the bow wave distribution into account in the design of stages a through d.

Furthermore, during operation of the combustion chamber 2, flow conditions may arise in the gas path 9 thereof which produce varying flow velocities or varying pressures in the circumferential direction, at least in the outlet region 6. This pressure distribution which varies in the circumferential direction may be stationary in a stationary operating state of the gas turbine system 1. Accordingly, here as well the influence of a pressure distribution produced in the gap 4 as a result of operation of the combustion chamber 2 may be reduced or used for the desired cooling gas distribution by suitably designing stages a through d.

The measures provided according to the invention, which may be implemented separately or in an given cumulative manner, are characterized in that the cooling gas flow in the gap 4 may be significantly influenced without appreciably enlarging the surface of the combustion chamber 2 or turbine 3 exposed to the hot working gases. An enlarged surface, as implemented, for example, by airfoil members protruding into the gas path, at the same time increases the cooling demand for the airfoil members and in this respect is disadvantageous.

LIST OF REFERENCE CHARACTERS

1 Gas turbine system
2 Combustion chamber
3 Turbine
4 Gap
5 Cooling gas supply
6 Outlet region of the combustion chamber
7 Combustion chamber inner wall
8 Combustion chamber outer wall
9 Combustion chamber gas path
10 Inlet region of the turbine
11 Turbine inner wall
12 Turbine outer wall
13 Turbine gas path
14 Row of guide vanes
15 Guide vane
16 Inner gap
17 Outer gap
18 Thermal shield element
19 Outer platform for the turbine guide vane
20 Inner platform for the turbine guide vane
21 End section of 7
22 End section of 8
23 End section of 11
24 End section of 12

25 Front edge of guide vane
a Positive stage at 16
b Negative stage at 16
c Positive stage at 17
d Negative stage at 17
X Longitudinal center axis/rotational axis While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

The invention claimed is:

1. A gas turbine system for a utility power plant, the system comprising:

a combustion chamber comprising an inner chamber wall and an outer chamber wall which define an annular outlet region and radially delimit a combustion chamber gas path;

a turbine comprising a turbine inner wall and a turbine outer wall which define a stationary annular inlet region and radially delimit a turbine gas path;

a radially inward, radially outward, or both, axial gap between the combustion chamber and the turbine, at which axial gap the inner chamber wall, the outer chamber wall, or both, and the turbine inner wall, the turbine outer wall, or both, end;

a cooling gas supply, which via the axial gap can introduce a cooling gas into the turbine gas path, into the combustion chamber gas path, or into both;

wherein an end section of a respective turbine wall, of a respective chamber wall, or of both, adjoining the gap is radially inwardly, radially outwardly, or both, formed so that, in the circumferential direction at the gap, positive stages and negative stages alternate;

wherein a positive stage comprises a respective wall situated downstream of the axial gap radially projecting into the respective gas path relative to a respective wall situated upstream of the axial gap;

wherein a negative stage comprises a respective wall situated upstream of the axial gap radially projecting into the respective gas path relative to a respective wall situated downstream of the axial gap; and wherein a configuration of said circumferentially alternating positive and negative stages is a function of a cooling demand which circumferentially varies and which results at the axial gap during operation of the gas turbine system.

2. A gas turbine system according to claim 1, wherein:

the turbine comprises a first row of guide vanes in the stationary annular inlet region, each guide vane having a pressure side and a suction side; and a configuration of said circumferentially alternating positive and negative stages is a function of a circumferential distribution of the alternating pressure sides and suction sides of the guide vanes.

3. A gas turbine system according to claim 1, wherein:

the turbine comprises a first row of guide vanes in the stationary annular inlet region, each guide vane having a pressure side and a suction side; and a configuration of said circumferentially alternating positive and negative stages is a function of bow waves, generated during operation of the gas turbine system, consecutively following one another at intervals in the circumferential direction, and propagating upstream, of the guide vanes.

4. A gas turbine system according to claim 1, wherein a configuration of said circumferentially alternating positive and negative stages is a function of a pressure distribution which varies in the circumferential direction and which results at or in the annular outlet region during operation of the gas turbine system.

5. A gas turbine system according to claim 1, wherein a positive stage comprises:

the inner chamber wall, in an end section adjoining the axial gap, extending radially inwardly relative to circumferentially adjoining regions of the inner chamber wall on both sides of said positive stage; or the turbine inner wall, in an end section adjoining the axial gap, extending radially outwardly relative to circumferentially adjoining regions of the turbine inner wall on both sides of said positive stage; or both.

6. A gas turbine system according to claim 1, wherein a negative stage comprises:

the inner chamber wall, in an end section adjoining the axial gap, extending radially outwardly relative to circumferentially adjoining regions on both sides of said negative stage; or the turbine inner wall, in an end section adjoining the axial gap, extending radially inwardly relative to circumferentially adjoining regions on both sides of said negative stage; or both.

7. A gas turbine system according to claim 1, wherein a positive stage comprises:

the outer chamber wall, in an end section adjoining the axial gap, extending radially outwardly relative to circumferentially adjoining regions on both sides of said positive stage; or the turbine outer wall, in an end section adjoining the axial gap, extending radially inwardly relative to circumferentially adjoining regions on both sides of said positive stage; or both.

8. A gas turbine system according to claim 1, wherein a negative stage comprises:

the outer chamber wall, in an end section adjoining the axial gap, extending radially inwardly relative to circumferentially adjoining regions on both sides of said negative stage; or the turbine outer wall, in an end section adjoining the axial gap, extending radially outwardly relative to circumferentially adjoining regions on both sides of said negative stage; or both.

9. A gas turbine system according to claim 1, further comprising:

circumferential, continuous transitions between said positive stage and adjoining regions, between said negative stage and adjoining regions, or both, in respective end sections of the inner chamber wall, or the outer chamber wall, or the turbine inner wall, or the turbine outer wall, or combinations thereof.

* * * * *